US009239138B2

(12) United States Patent
Nourbakhsh et al.

(10) Patent No.: US 9,239,138 B2
(45) **Date of Patent: *Jan. 19, 2016**

(54) LED BULB OPTICAL SYSTEM WITH UNIFORM LIGHT DISTRIBUTION

(71) Applicant: BBY SOLUTIONS, INC., Minneapolis, MN (US)

(72) Inventors: Farhad Nourbakhsh, Apple Valley, MN (US); Xiyuan He, Shenzhen (CN); Dave Carroll, Grantsburg, WI (US); Wendell Carroll, Minneapolis, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/556,764

(22) Filed: Dec. 1, 2014

(65) Prior Publication Data

US 2015/0084497 A1 Mar. 26, 2015

Related U.S. Application Data

(63) Continuation of application No. 13/835,591, filed on Mar. 15, 2013, now Pat. No. 8,899,794.

(51) Int. Cl.

| | |
|---|---|
| ***F21K 99/00*** | (2010.01) |
| ***F21V 3/04*** | (2006.01) |
| ***F21V 3/02*** | (2006.01) |
| ***F21V 29/506*** | (2015.01) |
| *F21Y 101/02* | (2006.01) |
| *F21Y 111/00* | (2006.01) |

(52) U.S. Cl.
CPC . *F21K 9/50* (2013.01); *F21K 9/135* (2013.01); *F21V 3/02* (2013.01); *F21V 3/049* (2013.01); *F21V 29/506* (2015.01); *F21Y 2101/02* (2013.01); *F21Y 2111/002* (2013.01)

(58) Field of Classification Search
CPC ..... F21Y 2101/02; F21Y 2111/007; F21Y 2111/005; F21K 9/56; F21K 9/50; F21S 48/2243
See application file for complete search history.

(56) References Cited

U.S. PATENT DOCUMENTS

| | | | |
|---|---|---|---|
| 6,036,340 | A | 3/2000 | Fohl et al. |
| 8,193,702 | B2 | 6/2012 | Lenk |
| 8,299,695 | B2 | 10/2012 | Simon et al. |
| 8,562,161 | B2 | 10/2013 | Tong et al. |
| 8,637,877 | B2 | 1/2014 | Negley |
| 2003/0021113 | A1 | 1/2003 | Begemann |
| 2006/0034077 | A1 | 2/2006 | Chang |
| 2010/0207502 | A1 | 8/2010 | Cao et al. |
| 2010/0264799 | A1 | 10/2010 | Liu et al. |
| 2011/0103055 | A1 | 5/2011 | Carroll |
| 2011/0215699 | A1 | 9/2011 | Le et al. |
| 2011/0215700 | A1 | 9/2011 | Tong et al. |
| 2011/0255279 | A1 | 10/2011 | Finkelstein et al. |

OTHER PUBLICATIONS

Energy Star Program Requirements for Integral LED Lamps, Partner Commitments, pub: 0101-01-2012.

*Primary Examiner* — Tracie Y Green
(74) *Attorney, Agent, or Firm* — Beck Tysver Evans, PLLC; Daniel Tysver

(57) ABSTRACT

A pear-shaped light-emitting diode (LED) light bulb housing is provided with a plurality of light-dispersing thickness variations in the bulb envelope. Dimples, bumps, or v-shaped grooves are provided in a middle portion of the bulb envelope in order to uniformly disperse light from LEDs as the light passes through the bulb envelope.

10 Claims, 11 Drawing Sheets

LED BULB OPTICAL SYSTEM WITH UNIFORM LIGHT DISTRIBUTION

FIELD OF THE INVENTION

The present application relates to the field of light-dispersing optics for light-emitting diode (LED) light bulbs. More particularly, the described embodiments relate to a bulb housing having light-dispersing dimples, bumps, or grooves to increase the uniformity of light emitted from LEDs within an LED light bulb.

BACKGROUND

Light-emitting diode (LED) light bulbs are becoming increasingly popular as an alternative to traditional incandescent light bulbs. However, LED light bulbs have disadvantages versus incandescent bulbs because of the high directionality of LEDs. Whereas incandescent light bulbs direct light uniformly around the entire bulb, LEDs within LED light bulbs create "hot spots" where the light intensity is very high relative to the average light intensity of the light bulb. This feature is undesirable for a general-purpose consumer light bulb.

SUMMARY

One embodiment of the present invention provides an LED light bulb having a bulb envelope with light-dispersing thickness variations. The bulb may be an A19-style bulb, which has a pear-shaped bulb housing and an electrical screw base that is compatible with most consumer household lighting fixtures.

DETAILED DESCRIPTION

Figure 1:
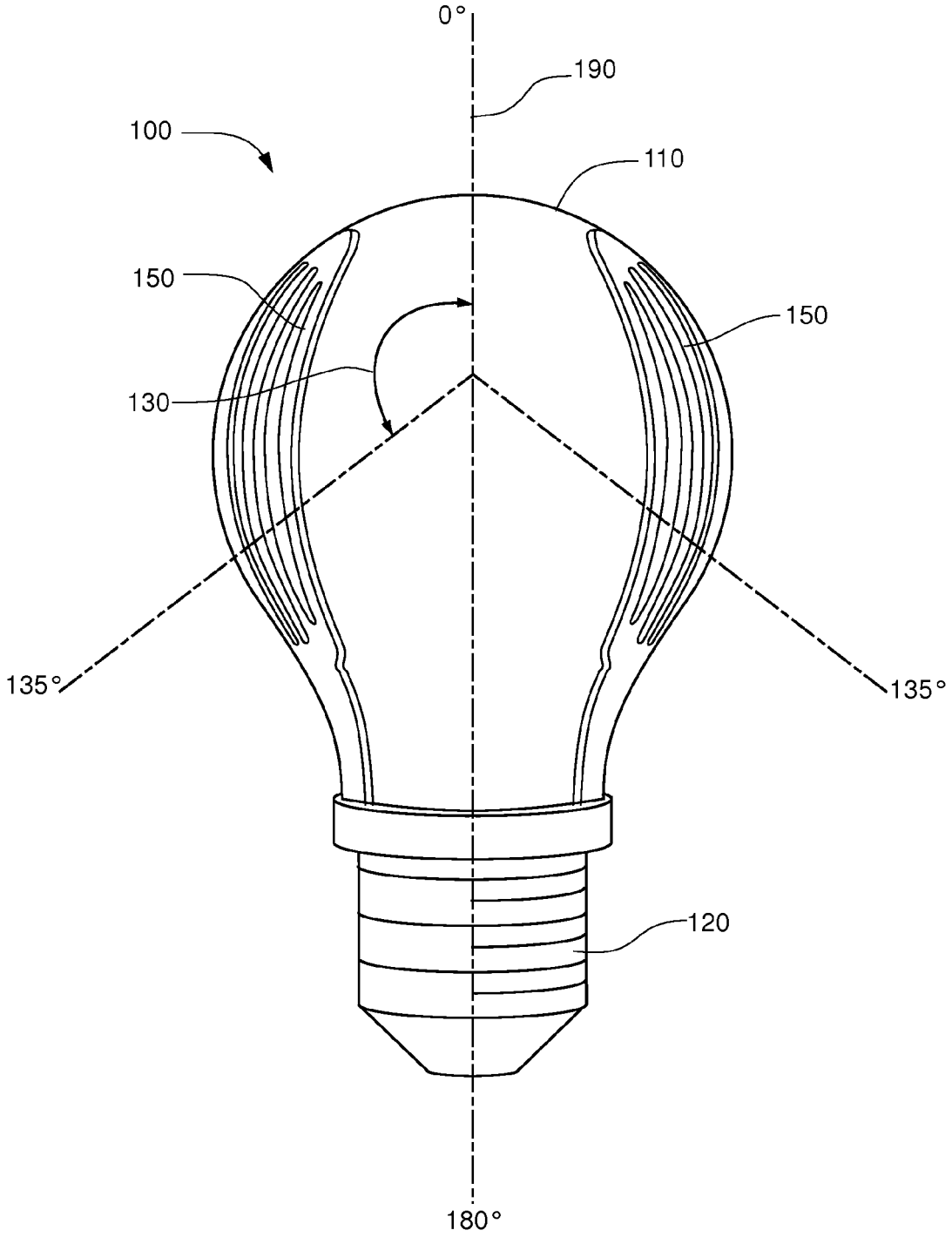
FIG. 1 is a perspective view of an LED light bulb.

FIG. 1 shows a perspective view of one style of LED light bulb 100. The bulb 100 is a pear-shaped A-style bulb (e.g., an A15, A19, A21, or A23). The bulb 100 includes an electrical screw base 120 that is compatible with a standard consumer light fixture, making the bulb 100 an acceptable replacement for a standard incandescent light bulb. The bulb 100 has a bulb envelope 110 and heat sinks 150 structurally integrated into the bulb 100. The heat sinks 150 have a wing-like form that surrounds the bulb envelope 110 and forms part of the pear shape of the bulb 100.

One purpose of the present disclosure is to create uniformity in the light emitted from the light bulb 100. Specifically, it is desirable to create such uniformity that the amount of light emitted at any angle in a three-dimensional zone 130 between 0° and 135° with respect to a vertical axis 190 be no more than 20% higher or lower than the mean light intensity emitted over the entire zone. This may be partially accomplished by creating a "frosted" bulb envelope 110 out of a light-diffusing glass or plastic material. The "frosted" effect is created by a material that is partially opaque, causing light from the LEDs to diffuse in different directions as the light exits the bulb envelope 110. However, a frosted bulb envelope 110 is not able to create the desired uniformity of no more than a 20% deviation in light intensity over the entire zone between 0° and 135°.

Figure 2:
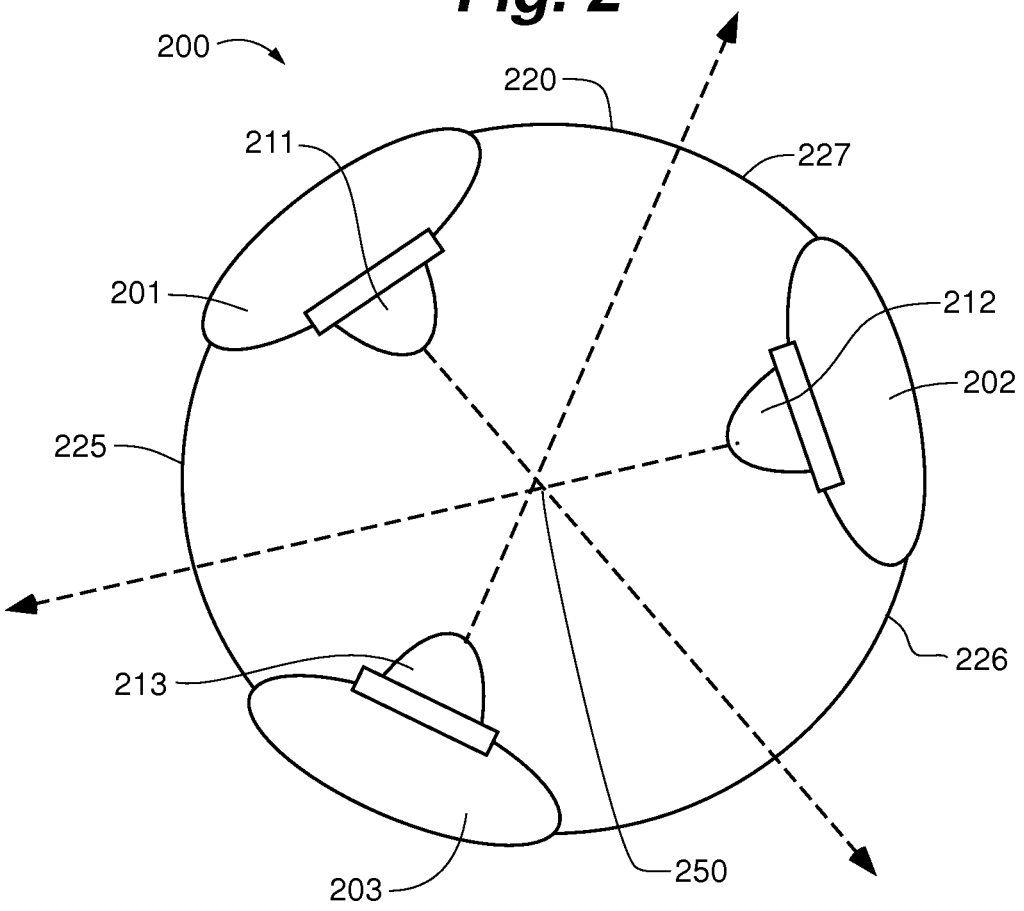
FIG. 2 is a schematic diagram showing a top view of an LED light bulb.

FIG. 2 shows a top view of a light-emitting diode light bulb 200 having a bulb envelope 220 and three wings 201, 202, 203. The wings 201-203 (which may function as heat sinks for the bulb) divide the bulb envelope 220 into bulb envelope partitions 225, 226, 227. The wings 201, 202, 203 have light-emitting diodes 211, 212, and 213 that are mounted on the wings 201, 202, 203. The LEDs 211-213 are directed approximately toward a vertical center axis 250 of the LED light bulb 200. (The axis 250 is similar to vertical axis 190 of FIG. 1). The LED 211 mounted on wing 201 points toward partition 226; LED 212 mounted on wing 202 points toward partition 225; and LED 213 mounted on wing 203 points toward partition 227. If the bulb envelope 220 is made of a clear material, the LEDs 211-213 produce undesirable hot spots of light.

Figure 3:
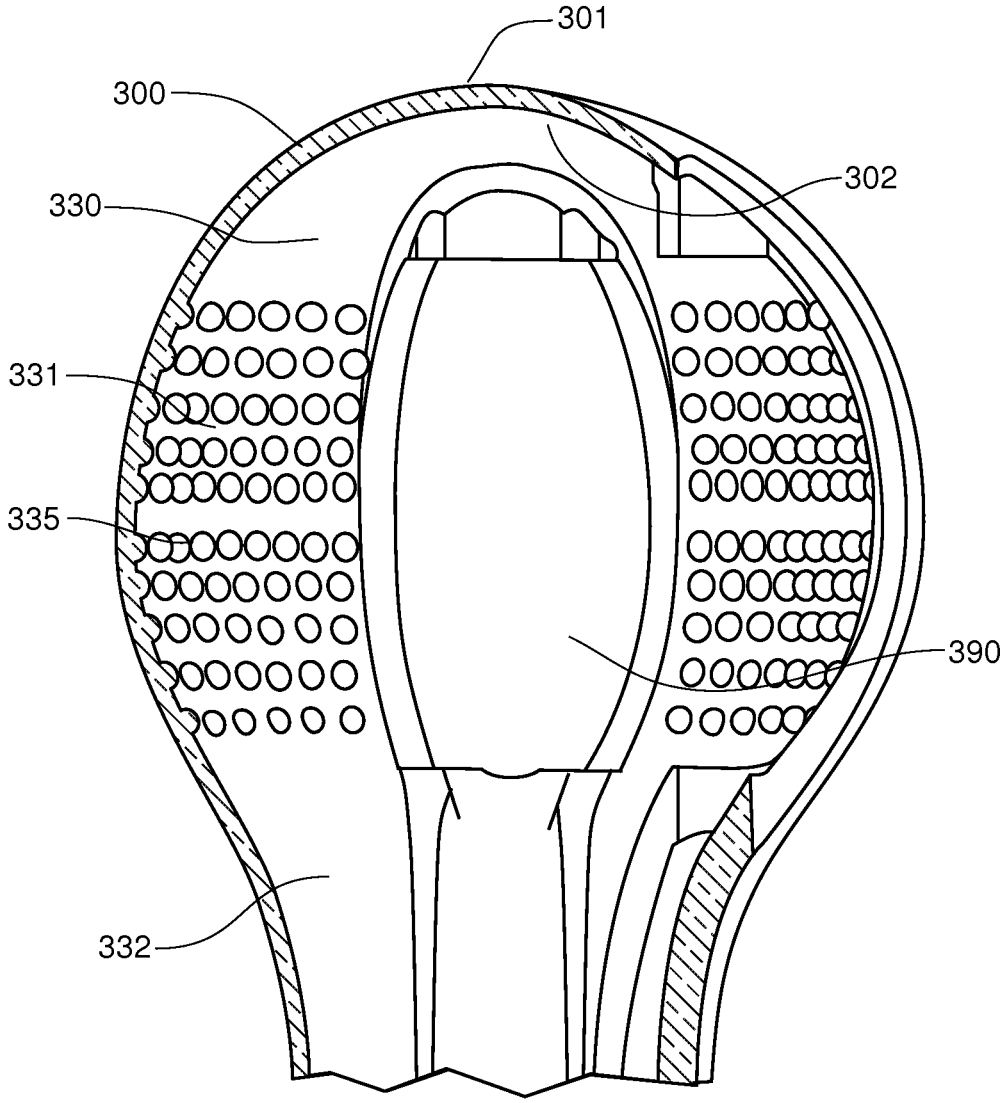
FIG. 3 is a cutaway view of an LED light bulb envelope with dimples.

FIG. 3 shows a first embodiment of an LED light bulb envelope 300 having light-dispersing properties. The bulb envelope 300 has an outer surface 301 and an interior surface 302. The outer surface 301 is smooth. The thickness of the bulb envelope changes based on surface features of the interior surface 302. The bulb envelope 300 is divided into portions of uniform thickness and variable thickness. An upper domed portion 330 of the bulb envelope 300 has a uniform thickness. A lower tapered portion 332 of the bulb envelope 300 also has a generally uniform thickness. The middle portion 331 of the bulb envelope 300 has surface features 335 that create variable thickness in the bulb envelope 300. In FIG. 3, the middle portion 331 has light-dispersing dimples or bumps 335 that cause light from LEDs within the light bulb to scatter in a controlled direction while the upper domed portion 330 and the lower tapered portion 332 have fewer or no light scattering dimples or bumps 335. The light-scattering properties of the thickness variations 335 decrease hot spots, causing the light emitted from the bulb to have increased uniformity. In one embodiment of the LED light bulb, the bulb envelope 300 has a cutout 390 that holds wing structures with LEDs mounted thereon.

Figure 4:
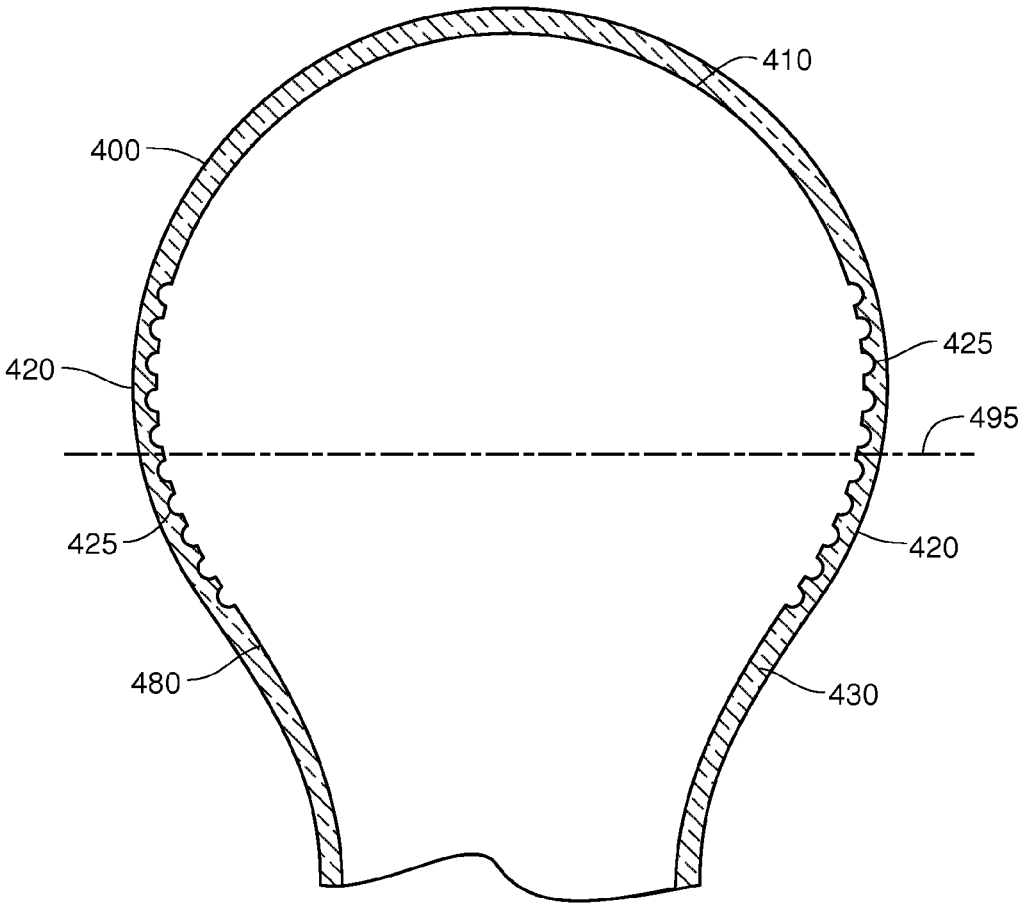
FIG. 4 is a cross-sectional view of a bulb envelope having concave dimples.

FIG. 4 shows a cross-sectional view of a pear-shaped bulb envelope 400 having light-dispersing dimples 425. A domed upper portion 410 and a tapered lower portion 430 of the bulb envelope 400 have a generally uniform thickness. A bulged middle portion 420 has an outwardly-curved shape. The middle portion 420 has many dimples 425 that decrease the thickness of the bulb envelope 400.

In one embodiment, the dimples 425 are partial-spherical depressions evenly distributed in rows around the middle portion 420. In alternative embodiments, the dimples 425 may be half-spherical or ovoid depressions in the bulb envelope 400. The dimples 425 may be distributed randomly around the middle portion 420; the dimples 425 may be distributed in clusters; or the dimples 425 may be distributed in a gradient with respect to a horizontal center 495 of the middle portion 420, where the dimples 425 are spaced close together near the horizontal center 495 of the middle portion 420, and farther apart near the portions 410 and 430 of bulb envelope 400. The dimples may be equally sized, or the dimples 425 may vary in size to be smaller or larger depending on how much light dispersion is needed at a particular point in the bulb envelope 400. Size variations of the dimples may vary the diameter of the dimples, or the depth of the dimples within the bulb envelope 400. Dimples that are very small and closely spaced provide more light dispersion than larger dimples that are spaced farther apart.

Figure 5:
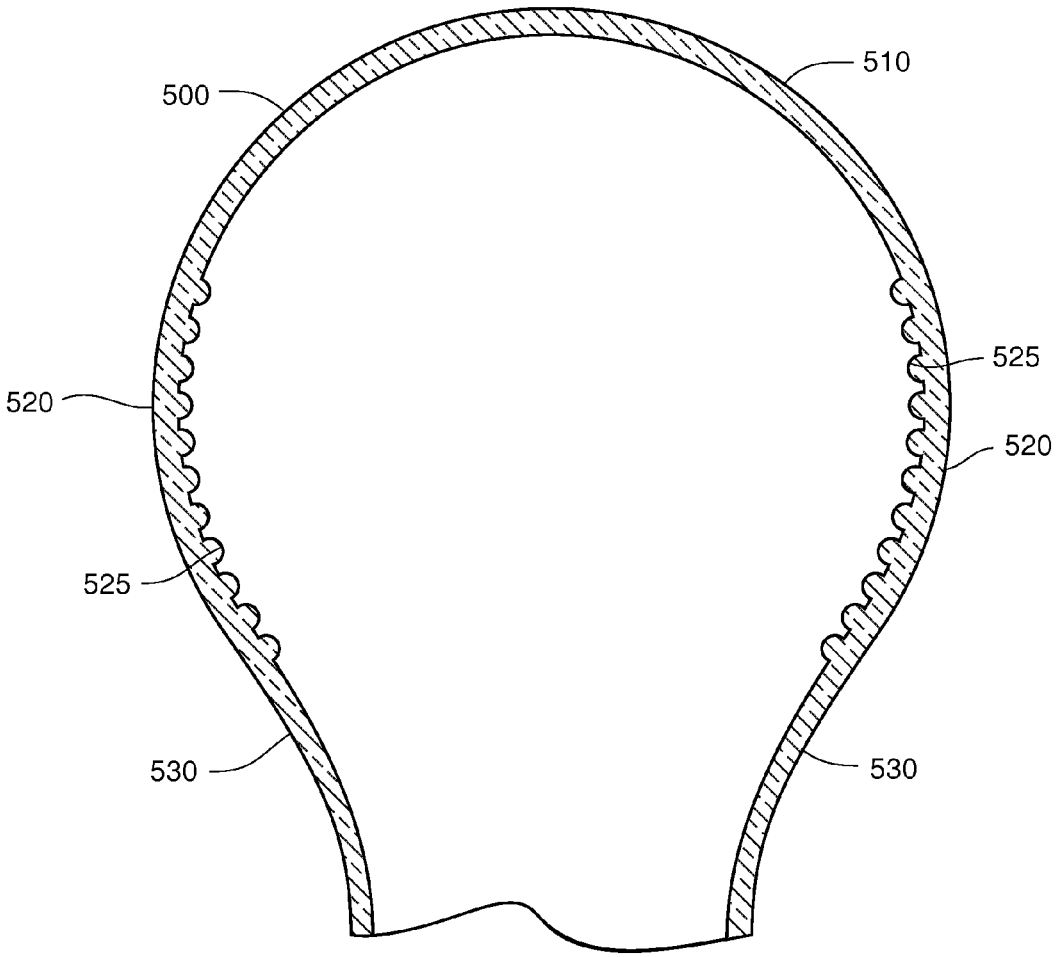
FIG. 5 is a cross-sectional view of a bulb envelope having interior surface bumps.

FIG. 5 shows a cross-sectional view of a bulb envelope 500 having bumps 525 that increase the thickness of the bulb envelope 500. The bulb envelope 500 has a domed section 510 and a tapered section 530 that have a generally uniform thickness. A bulged middle section 520 has bumps 525 that are convex protrusions that increase the thickness of the bulb envelope 500.

In one embodiment, the bumps 525 are convex protrusions. The bumps 525 may be partially spherical or ovoid. The bumps 525 may be distributed evenly in rows around the middle portion 520, or may be distributed randomly. The bumps 525 may be distributed in clusters, or in a gradient where bumps 525 are more closely spaced in some parts of the bulb envelope 500 and spaced farther apart in other parts.

Figure 6:
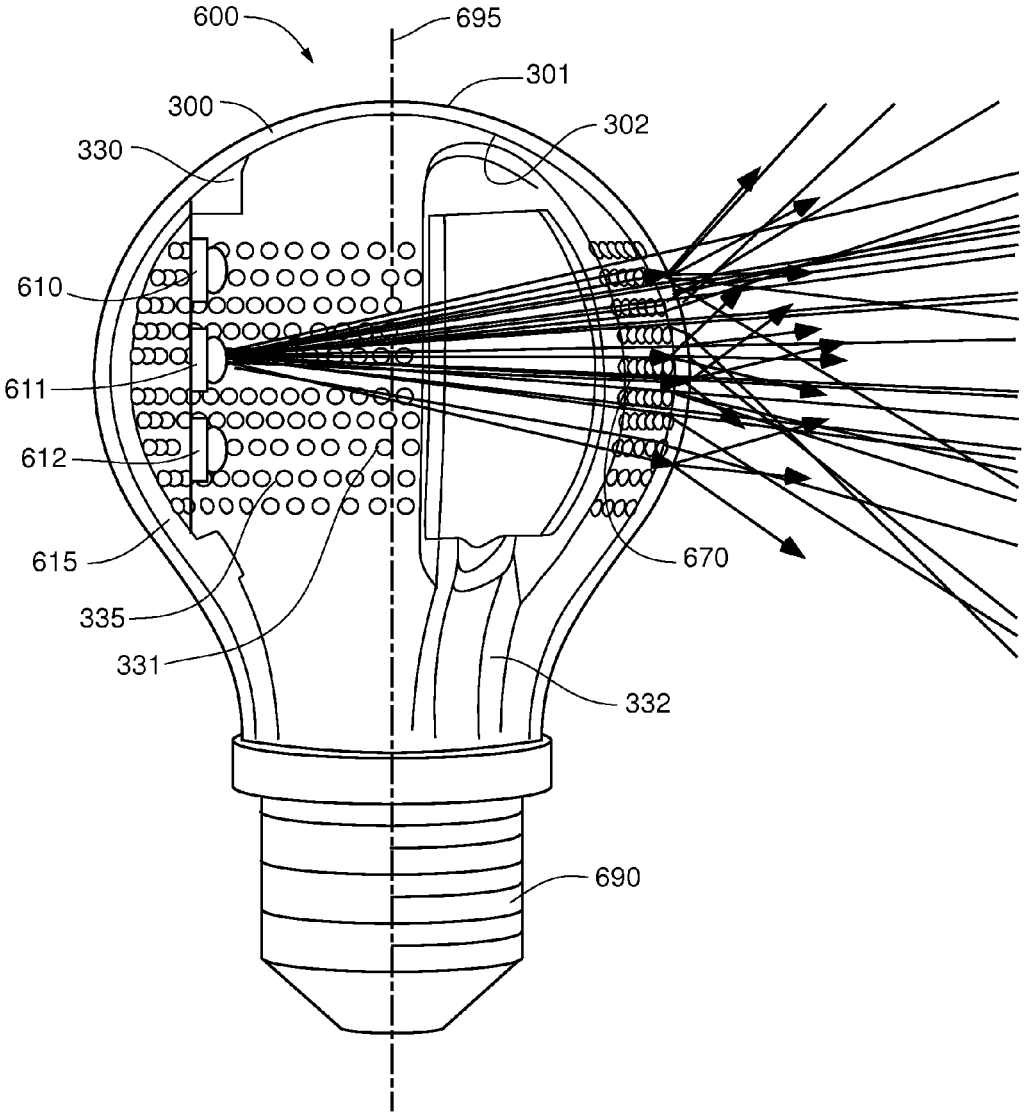
FIG. 6 shows light dispersal through the optical elements (dimples) in the bulb envelope.

FIG. 6 is a schematic view of an LED light bulb 600 using the bulb envelope 300 of FIG. 3. The light bulb 600 is preferably an A-style bulb with an electrical base 690. The light bulb 600 has the bulb envelope 300 with one or more wings 615 structurally integrated into the bulb housing 300. The wing 615 has one or more LEDs 610, 611, 612 mounted thereon. The LEDs are directed toward a center axis 695 of the light bulb 600. The LEDs are located within the middle portion 331 of the light bulb 600, which means that hot spots from the LEDs 610, 611, 612 are all found in this middle portion 331. Dimples or bumps 335 on the inside surface 302 of the bulb envelope 300 increase or decrease the thickness of the bulb envelope 300, causing the light 670 emitted from LED 622 to disperse as the light passes through the bulb envelope 300. Importantly, the dimples or bumps 335 are not equally distributed across the inside surface 302 of the bulb envelope 300. In particular, the number, size, or density of the dimples or bumps 335 varies so that maximum light is scattered in the middle portion 331 and less (or no) light is scattered by any dimples or bumps 335 that may be found in the upper domed portion 330 and the lower tapered portion 332 of the bulb envelope 300.

Figure 7:
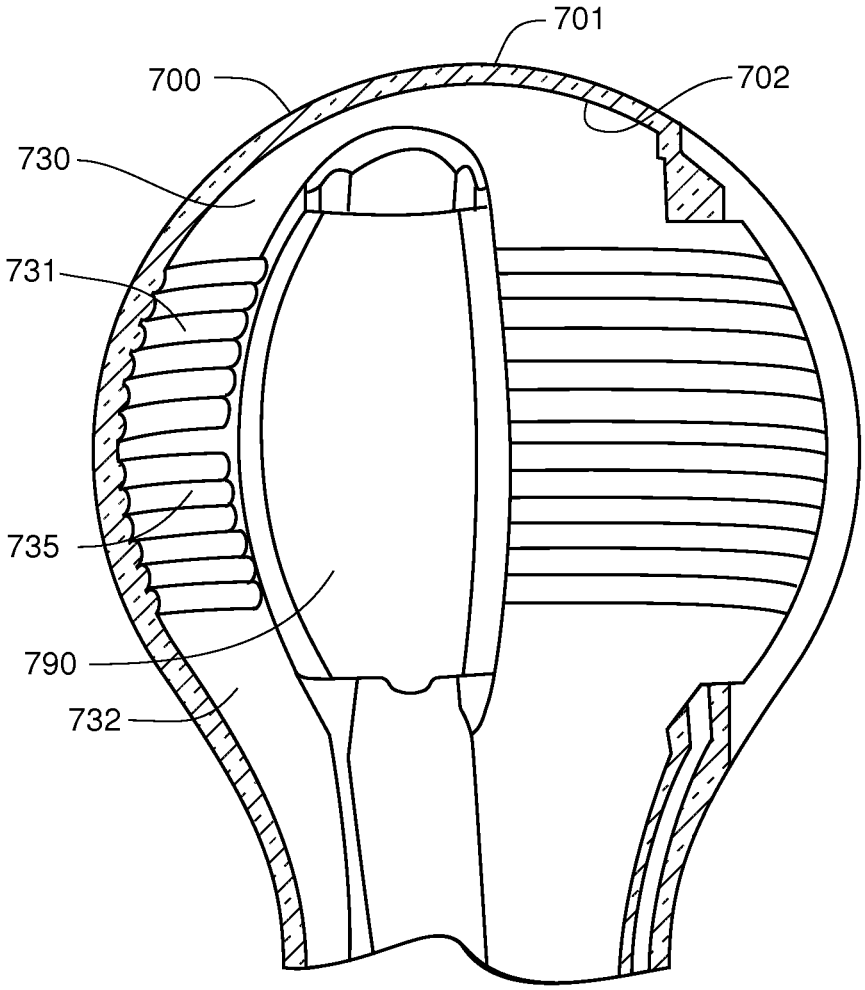
FIG. 7 is a cutaway view of an LED light bulb envelope with prism-like grooves.

FIG. 7 shows an alternative embodiment of an LED light bulb envelope 700 having prism-like light-dispersing grooves 735 in the bulb envelope 700. The bulb envelope 700 has an outer surface 701, an interior surface 702, and a cutout 790 that holds wing structures with LEDs mounted thereon. The outer surface 701 is smooth and uniform, and the thickness of the bulb envelope 700 changes based on surface features of the interior surface 702. The bulb envelope 700 has an upper domed section 730 and a bottom tapered portion 732 that have a generally uniform thickness. A bulged middle section 731 has many prism-like parallel, annular grooves 735 in the surface 702 that create variable thickness in the middle section 731 of the bulb envelope 700. In one embodiment, the grooves 735 are v-shaped grooves with an interior angle of approximately 60 degrees. Depending on the geometry of the light bulb and the distribution of the LEDs within the bulb, the interior angle could be greater or less than 60 degrees, as needed, to uniformly disperse light emitted from the LEDs.

Figure 8:
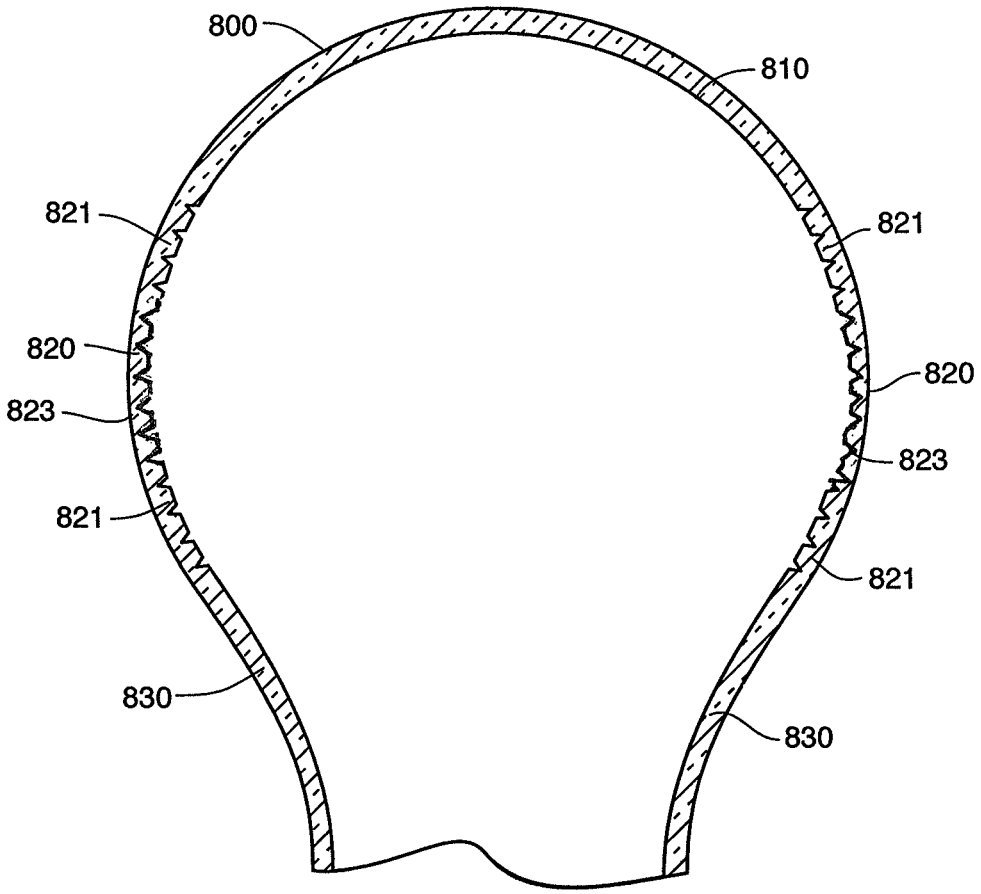
FIG. 8 is a cross-sectional view of a bulb envelope having grooves of different sizes.

FIG. 8 is a cross-sectional view of a bulb envelope 800 having grooves of different sizes. The bulb envelope 800 has an upper domed portion 810 and a lower tapered portion 830 that have a generally uniform thickness. A bulged middle portion 820 has a plurality of v-shaped grooves 821, 823. In the embodiment of FIG. 8, the grooves 821, 823 are evenly distributed in the middle portion 820. The distance between adjacent grooves 821, 823 is the same for all grooves 821, 823. The grooves 823 near the center of the middle portion 820 are larger than the grooves 821 at the peripheral edges of the middle section 820 near the domed portion 810 and the tapered portion 830. Each v-shaped groove 821, 823 may have an interior angle of approximately 60 degrees, but the interior angle could be smaller or larger, depending upon the application. The size of the grooves 821, 823 is dependent upon how deep the groove 821, 823 is cut into the bulb envelope 800. The grooves 823 around the center of the middle portion 820 are cut more deeply into the bulb envelope 800, and the grooves 823 are cut less deeply. In the embodiment of FIG. 8, the bulb envelope is thicker at the grooves 821 than at the grooves 823.

Figure 9:
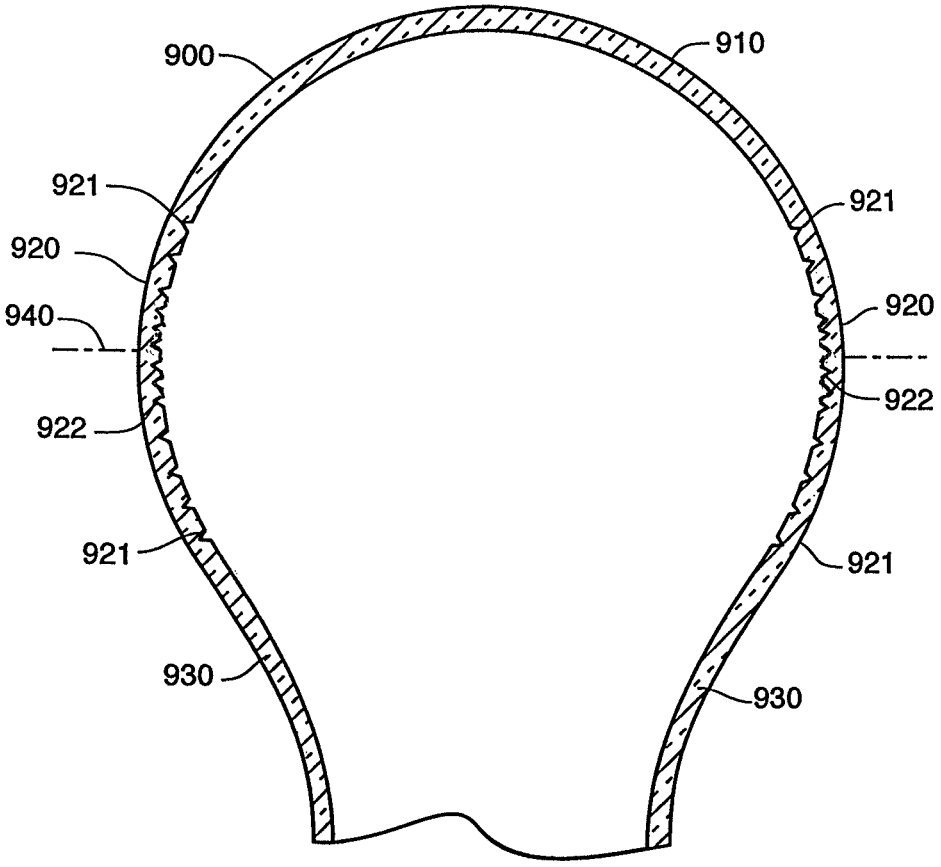
FIG. 9 is a cross-sectional view of a bulb envelope having grooves that are unevenly spaced.

FIG. 9 is a cross-sectional view of a bulb envelope 900 having grooves 921, 922 that are unevenly spaced. The bulb envelope 900 has a domed upper portion 910 and a tapered lower portion 930 that are of generally uniform thickness. A middle portion 920 of the bulb envelope 900 has a plurality of v-shaped groves 921, 922 cut into the bulb envelope 900. In one embodiment, the grooves 921, 922 have an interior angle of approximately 60 degrees. The interior angles could also be smaller or larger than 60 degrees. In the embodiment of FIG. 9, the distance between adjacent grooves 922 varies depending on the distance of the particular groove from a horizontal center 940 of the middle portion 920. The grooves 922 near the horizontal center 940 of the middle portion 920 are more closely spaced than the grooves 921 at the outer edges of the middle portion 920 near the upper portion 910 and lower portion 930. The more closely spaced grooves 922 scatter more light than the grooves 921 that are spaced farther apart.

In an alternative embodiment, a bulb envelope could combine the different types of grooves in the middle portion of the bulb. For example, in addition to being spaced farther apart, the grooves 921 could also be smaller than the grooves 922.

Figure 10:
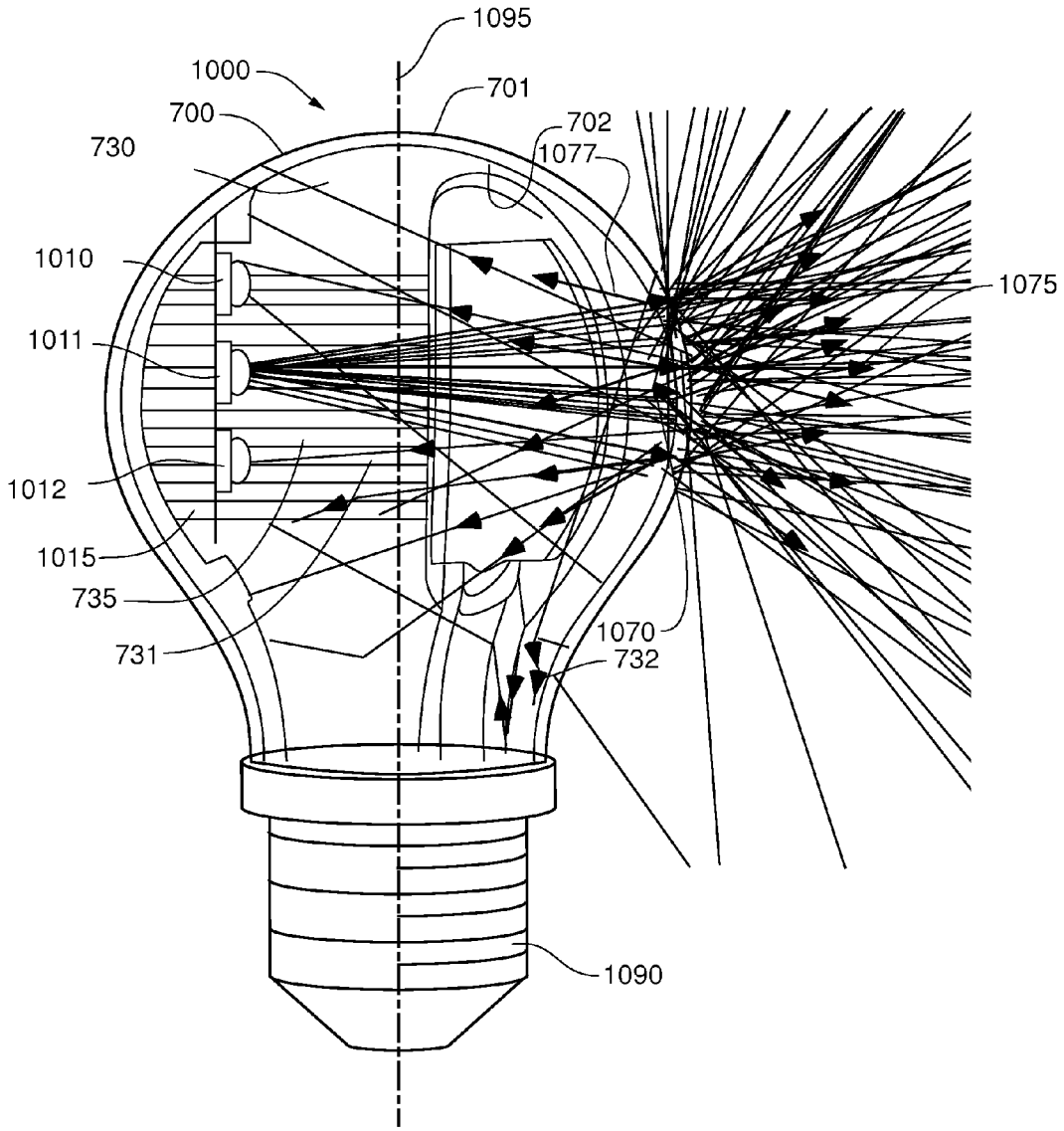
FIG. 10 shows light dispersal through the optical elements (grooves) in the bulb envelope.

FIG. 10 is a schematic view of an LED light bulb 1000 with the light-dispersing bulb envelope 700 of FIG. 7. The light bulb 1000 has an electrical screw base 1090 that is preferably compatible with an A-style consumer household socket. The light bulb 1000 has a plurality of wing structures 1015 integrated into the pear shape of the light bulb 1000. The wings 1015 have one or more LEDs 1010, 1011, and 1012 mounted thereon. The LEDs 1010-1012 are located in the middle bulged portion of the bulb envelope 700, and are directed toward a center vertical axis 1095 of the light bulb 1000. The LED 1011 emits light 1070 toward the opposite side of the bulb envelope 700. The light 1070 hits the grooves 735 on the bulb envelope 700. Some of the light 1070 passes through the bulb envelope as dispersed light 1075, and some of the light is backscattered 1077 into the bulb envelope 700, further dispersing the light rays and creating more uniformity in the light bulb 1000.

Figure 11:
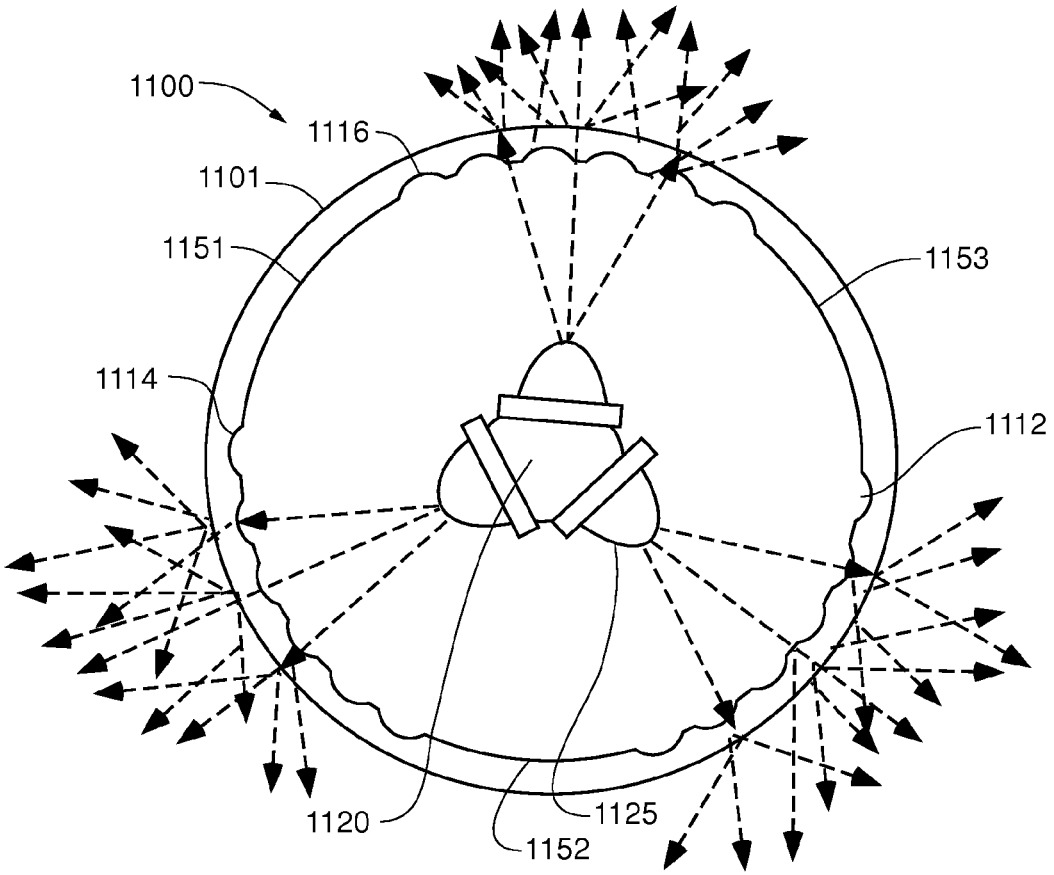
FIG. 11 is a cross-sectional top view of a bulb envelope for an LED light bulb having LEDs mounted on a center post.

FIG. 11 shows an alternative embodiment of an LED light bulb 1100 having a light-dispersing bulb envelope 1101. A plurality of LEDs 1125 within the bulb envelope 1101 are mounted on a center post 1120. In the embodiment of FIG. 11, the LEDs point in three different directions approximately 120 degrees apart with respect to a center vertical axis of the bulb. The bulb envelope 1101 has portions of uniform thickness and portions of variable thickness. The bulb envelope 1101 has three clusters 1112, 1114, 1116 of concave depressions or dimples in the bulb envelope 1101 that cause thickness variations in the bulb envelope 1101. Three sections 1151, 1152, 1153 having uniform thickness are disposed between the clusters of dimples 1112, 1114, 1116. The LEDs 1125 produce hotspots in only the areas around the dimple clusters 1112-1116. The sections 1151-1153 receive less light from the LEDs 1125, and therefore do not require the same amount of light dispersion from the dimples 1112-1116.

The many features and advantages of the invention are apparent from the above description. Numerous modifications and variations will readily occur to those skilled in the art. For example, a combination of dimples, bumps, and ridges could be combined in a single bulb envelope. Additionally, the bulb envelope could have a candle shape, a tubular shape, a globe shape, or other irregular shape. Since such modifications are possible, the invention is not to be limited to the exact construction and operation illustrated and described. Rather, the present invention should be limited only by the following claims.

What is claimed is:

1. A light-emitting diode light bulb comprising:

a) a bulb envelope having i) a base portion, ii) an upper portion, and iii) a middle portion extending between the base and upper portions;

b) a plurality of light-dispersing thickness variations in the middle portion of the bulb envelope; and c) a plurality of light-emitting diodes pointing toward the light-dispersing thickness variations in the middle portion of the bulb envelope.

2. The light bulb of claim 1, wherein the light-dispersing thickness variations comprise a plurality of concave dimples.

3. The light bulb of claim 2, wherein the concave dimples are aligned in parallel rows.

4. The light bulb of claim 1, wherein the light-dispersing thickness variations comprise v-shaped grooves.

5. The light bulb of claim 1, wherein the light-dispersing thickness variations comprise convex bumps.

6. The light bulb of claim 1, wherein the plurality of light-emitting diodes are mounted on external wings integrated into the bulb envelope.

7. The light bulb of claim 1, wherein the plurality of light-emitting diodes are mounted on an internal structure located within the bulb envelope.

8. The light bulb of claim 1, wherein the base portion and the upper portion have a relatively uniform thickness without light-dispersing thickness variations.

9. The light bulb of claim 1, wherein the upper portion has light-dispersing thickness variations.

10. The light bulb of claim 1, wherein the bulb envelope has a pear shape, with the base portion having a tapered shape, the middle portion have an outwardly-bulged shape, and the upper portion having a domed convex shape.

* * * * *